US006276074B1

(12) United States Patent
Martin

(10) Patent No.: US 6,276,074 B1
(45) Date of Patent: Aug. 21, 2001

(54) FOOTWEAR

(75) Inventor: Paul Martin, Dublin (IE)

(73) Assignee: Marcove Holdings Limited, Dublin (IE)

( * ) Notice: Subject to any disclaimer, the term of this patent is extended or adjusted under 35 U.S.C. 154(b) by 0 days.

(21) Appl. No.: 09/519,858

(22) Filed: Mar. 6, 2000

(30) Foreign Application Priority Data

Mar. 5, 1999 (IE) ..... S990182

(51) Int. Cl.[7] ..... A43B 3/24; A43B 3/28; A63H 33/00

(52) U.S. Cl. ..... 36/100; 36/1; 36/9 R; 36/112; 36/139; 446/26; 446/327

(58) Field of Search ..... 36/1, 9 R, 100, 36/112, 136, 139; 446/26, 327, 329, 369

(56) References Cited

U.S. PATENT DOCUMENTS

| | | | | |
|---|---|---|---|---|
| 2,205,091 | * | 6/1940 | Geffner | 36/9 R |
| 2,598,218 | | 5/1952 | Brumby | 36/2.5 |
| 3,023,420 | * | 3/1962 | Tann | 36/9 R |
| 3,226,849 | | 1/1966 | Rosen | 36/1 |
| 3,942,283 | * | 3/1976 | Rushton | 446/329 |
| 4,838,827 | * | 6/1989 | Schlaifer | 446/327 |
| 5,058,293 | * | 10/1991 | Villar | 36/136 |
| 5,402,590 | * | 4/1995 | Lee | 36/139 |
| 5,649,376 | * | 7/1997 | Lecates, Jr. | 36/139 |

FOREIGN PATENT DOCUMENTS 2243759A 11/1991 (GB) .

* cited by examiner

*Primary Examiner*—M. D. Patterson
(74) *Attorney, Agent, or Firm*—Jacobson Holman, PLLC

(57) ABSTRACT

The invention provides a slipper in combination with a hand puppet. The slipper comprises a sole and an associated upper attached to the sole and forming therewith a foot pocket having an inlet opening for reception of a persons foot. Decoration is provided on the upper representing a puppet character such as a head. Either a set of finger slots or a pocket is provided in the sole so that a person, by inserting their fingers into the slots or by insertion of their hand into the pocket, can manipulate the puppet character in the manner of a glove puppet.

9 Claims, 6 Drawing Sheets

FOOTWEAR

FIELD OF THE INVENTION

This invention relates to footwear, and in particular to slippers.

SUMMARY OF THE INVENTION

According to the invention, there is provided a slipper in combination with a hand puppet. In a particularly preferred embodiment, the slipper comprises a sole having an upper attached to the sole and forming therewith a pocket for reception of a person's foot, decoration representing a puppet character being provided on the slipper and hand gripping means on the slipper associated with the puppet character for gripping the slipper and manipulating the puppet character by hand to animate the puppet character. Thus, the slipper can be worn on a foot in a conventional manner or can be used as a hand puppet for entertainment purposes.

In one embodiment of the invention, the hand gripping means is provided on the sole.

In an alternative arrangement, the hand gripping means may be provided on the upper.

In a further embodiment, the hand gripping means comprises a set of finger receiving slots. Preferably, the finger receiving slots are provided on the sole. Most preferably, four finger receiving slots are provided adjacent a front end of the sole and an associated thumb receiving slot is provided adjacent a heel end of the sole.

In another embodiment, the hand gripping means comprises a pocket for reception of a person's hand. Conveniently, the pocket may be in the form of a glove as this would aid in manipulating the puppet.

In a preferred embodiment, the pocket is provided on the sole. In this arrangement, the pocket may have a hand inlet opening adjacent a heel end of the sole.

Alternatively, the pocket may have a hand inlet opening intermediate a toe end and a heel end of the sole defining a pocket which extends in opposite directions from the hand inlet opening towards the toe end and towards the heel end of the sole. This allows opposition of the thumb and fingers to facilitate manipulation of the puppet.

In a further embodiment, an inlet of the pocket is closed by a flap which is integrally formed with an outer layer of the sole, said flap being movable between a closed position sealing the opening and an open position allowing access to the opening, with retaining means for releasably securing the flap in a closed position. Conveniently, the retaining means may comprise complementary interengagable hook and pile fasteners on the flap and at the heel end. Conveniently, the sole can be formed in two layers, namely an inner layer and an outer layer with the flap being formed in the outer layer at a rear or heel end of the outer layer, front portions of the inner and outer layers are permanently secured together about their periphery defining the pocket, and the heel ends of the layers are releasably secured together by means of the flap and the associated hook and pile fastener strips. Thus conveniently, a smooth bottom face to the sole is provided when the flap is closed for use of the slipper as footwear. In order to use the slipper as a puppet, the flap can be readily easily peeled back to allow a person insert his hand into the pocket.

In another embodiment, the puppet character is provided on a ground-engaging bottom face of the sole. In this case, the puppet character would typically be provided by surface decoration on the sole.

In a preferred embodiment, the puppet character is provided on the upper.

In a particularly preferred embodiment, the puppet character represents the head of a person or animal. It will be appreciated that the head may be that of either a real or an imaginary person or animal.

In a further embodiment, an inlet of the foot receiving pocket defined by the sole and the upper forms a mouth of the head.

It is also envisaged that means may be provided on the slipper for broadcasting a pre-recorded message or slogan.

Typically, a pair of slippers will be provided. Both of such slippers may include the same puppet character. Alternatively, each of the slippers in the pair of slippers may include a different puppet character.

In another aspect, the invention provides a slipper comprising a sole and having an upper attached to the sole and forming therewith a pocket having an inlet opening for reception of a person's foot, decoration being provided on at least the supper such that it represents the head of a person or animal, characterised in that the foot inlet opening forms the mouth of said head.

BRIEF DESCRIPTION OF THE DRAWINGS

The invention will be more clearly understood by the following description of some embodiments thereof, given by way of example only, with reference to the accompanying drawings, in which.

BRIEF DESCRIPTION OF THE PREFERRED EMBODIMENTS

Figure 1:
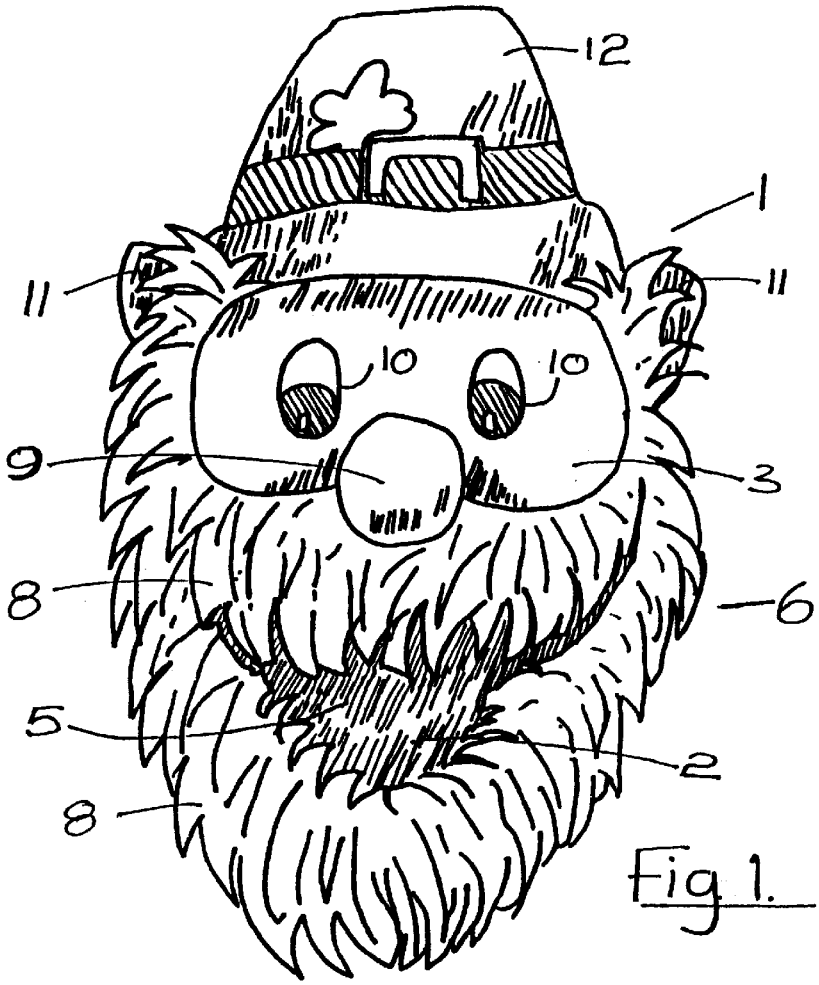
FIG. 1 is a plan view of a slipper according to the invention.
Figure 2:
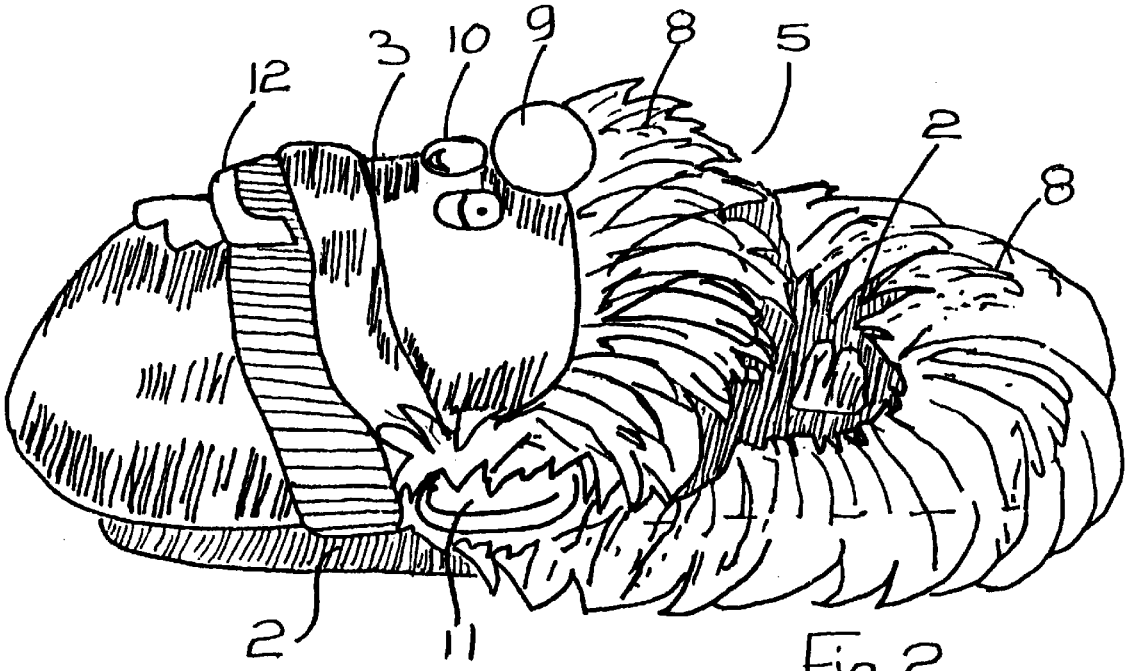
FIG. 2 is a perspective view of the slipper.
Figure 3:
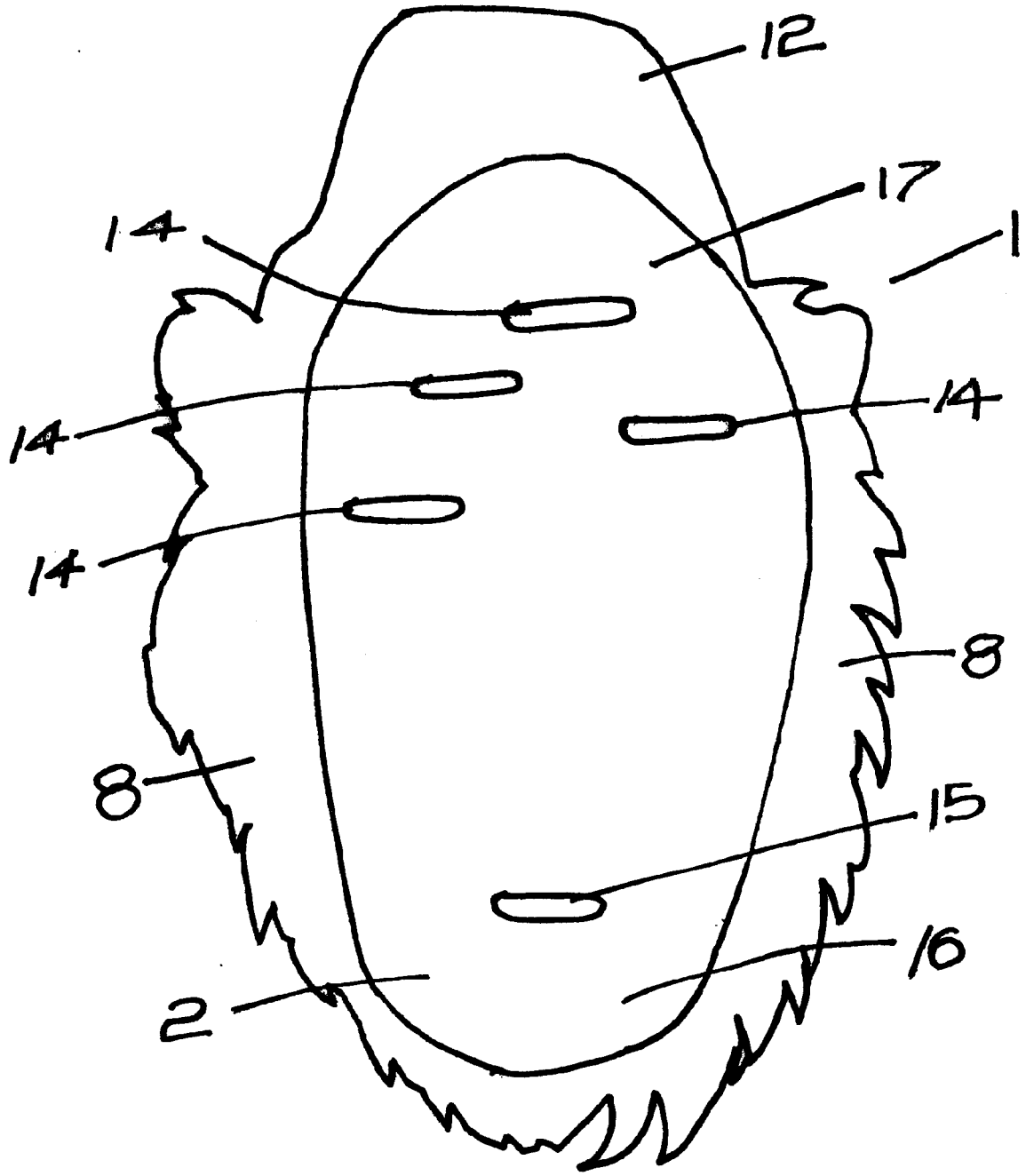
FIG. 3 is an underneath plan view of the slipper.

Referring to the drawings and initially to FIGS. 1 to 3 thereof, there is illustrated a slipper according to the invention, indicated generally by the reference numeral 1. Obviously, a pair or slippers would normally be provided, however, only one is shown as the general construction of both slippers would be similar. The slipper 1 comprises a sole 2 and an associated upper 3 attached to the sole 2 and forming therewith a foot pocket having an inlet opening 5 for reception of a person's foot. It will be noted that decoration representing a puppet character is provided on the upper 3 and sole 2 such that is represents a head 6 of, in this case, a person who happens to be a leprechaun figure. It will be noted that the decoration is arranged such that the foot inlet opening 5 forms the mouth of the head 6. The foot inlet opening 5 is surrounded by a beard 8 on the sole 2 and upper 3 and the head 6 further comprises a generally spherical nose l9, eyes 10 and ears 11. In this case, the head 6 is shown wearing a hat 12.

Referring to FIG. 3, a set of finger slots 14, 15 is provided in the sole 2 so that a person, by inserting the fingers of a hand in the slots 14, 15 can manipulate the slipper 1 in the manner of a glove puppet thus animating the head 6. As shown in the drawing, a slot 15 is provide in a heel end 16 of the sole 2 to receive a persons thumb to facilitate animation of the mouth and an associated array of four slots 14 are provided in a toe end 17 of the sole 2 for reception of a persons fingers.

The sole 2 itself will be typically formed by a pad of foam material encased in an outer fabric cover. Any other suitable cover or filling of flexible material may be used. The upper 3 may conveniently be formed of fabric materials which may form a casing which is padded with foam or other filling material to give a three dimensional effect and for added comfort when worn as a slipper.

In use, the slippers 1 can be used in conventional fashion as a pair of slippers, a user inserts their feet in the "mouth" of the head at the inlet opening 5. Also, if desired, the user can use a slipper 1 as a puppet by inserting fingers of a hand into the slots 14, 15 and manipulating the slipper/puppet 1.

As an alternative to the finger slots 14, a pocket or glove may be formed within the sole 2 having an opening at a heel end 16 of the sole 2 for insertion of a person's hand to manipulate the slipper 1 as a glove puppet. Various types of arrangement are shown in FIGS. 4 to 7.

Figure 4:
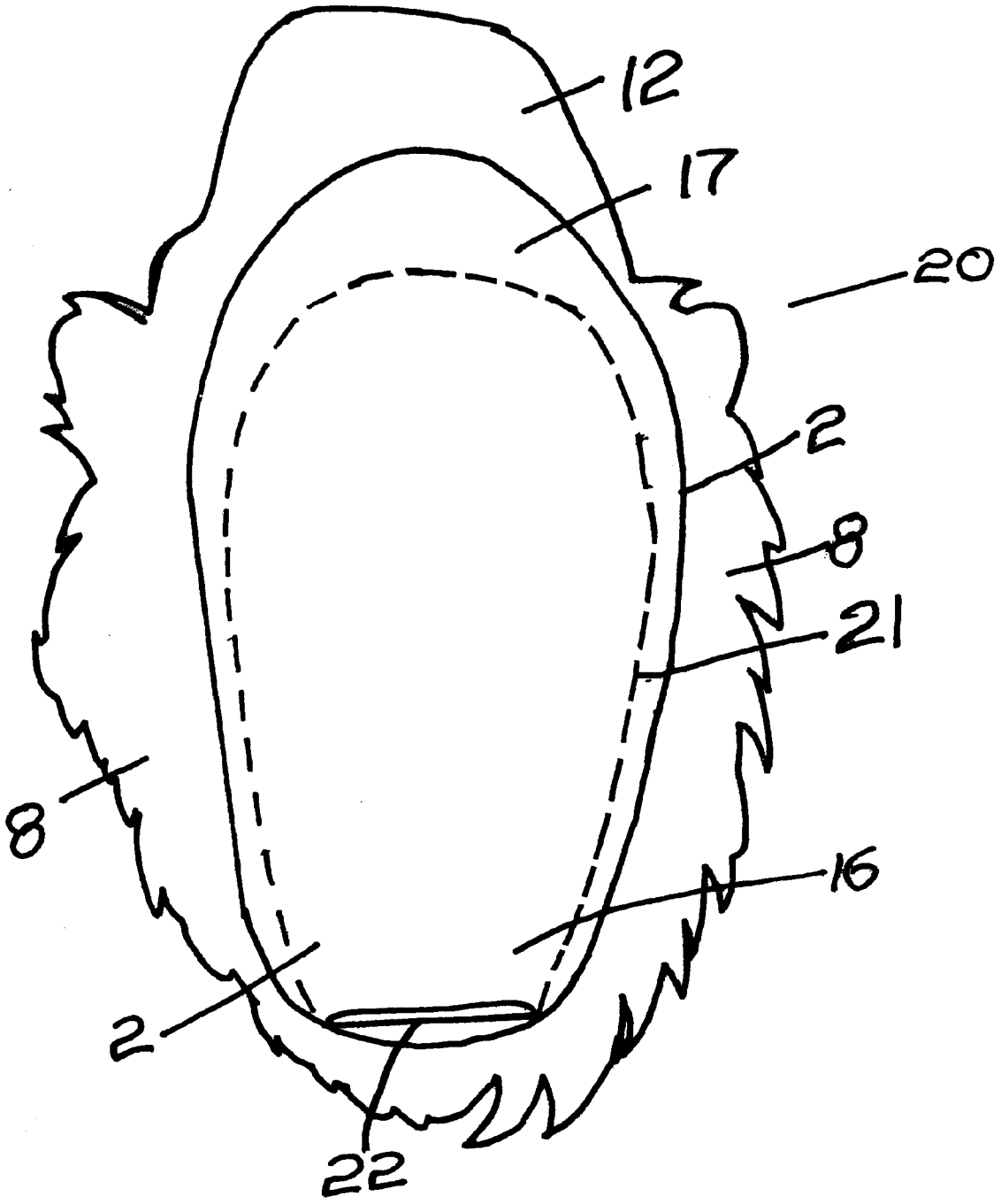
FIG. 4 is a view similar to FIG. 3 of another slipper according to a second embodiment of the invention.

Referring now to FIG. 4, there is shown another slipper according to a second embodiment of the invention indicated generally by the reference numeral 20. Parts similar to those described previously are assigned the same reference numerals. In this case, a pocket 21 is formed within the sole 2, said pocket 21 (indicated in broken outline) having a hand inlet opening 22 adjacent the heel end 16 of the sole 2. Operation of the slipper and puppet are as described previously, in this case, the user inserting his hand into the pocket 21 to operate the puppet.

It will be noted that the inlet opening for the pocket may be formed in either the bottom face of the sole or in a side edge of the sole which has the advantage of leaving a smooth bottom face to the sole. Further, the inlet to the pocket may be provided at any suitable location around the sole for insertion of the hand to provide the required manipulation of the puppet. For example, in some cases, the inlet to the pocket may be provided at the toe end of the sole rather than at the heel end as described.

Figure 5:
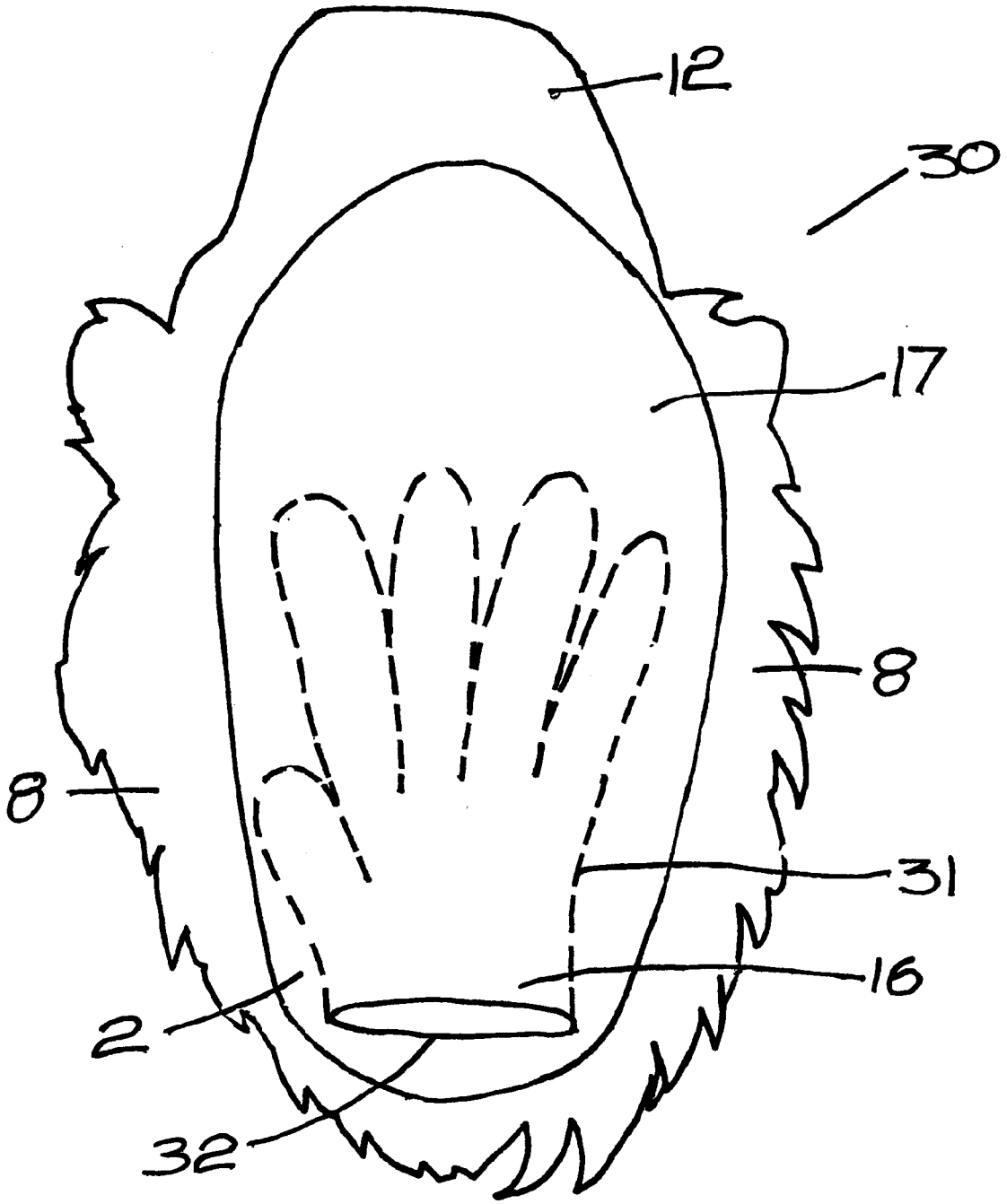
FIG. 5 is a view similar to FIG. 3 of a further slipper according to a third embodiment of the invention.

Referring now to FIG. 5, there is shown another slipper according to a third embodiment of the invention, indicated generally by the reference numeral 30. Parts similar to those described previously are assigned the same reference numerals. In this case, a pocket is provided in the sole 2 in the form of a glove 31 (indicated in broken outline) having a hand inlet opening 32 adjacent the heel end 16 of the sole 2. Use of the slipper 30 is as described previously for the slipper of FIGS. 1 to 3. In this case, to manipulate the puppet, the user inserts his hand through the inlet 32 into the glove 31 within the sole 2. This glove arrangement gives a more secure grip to aid in manipulation of the puppet.

Figure 6:
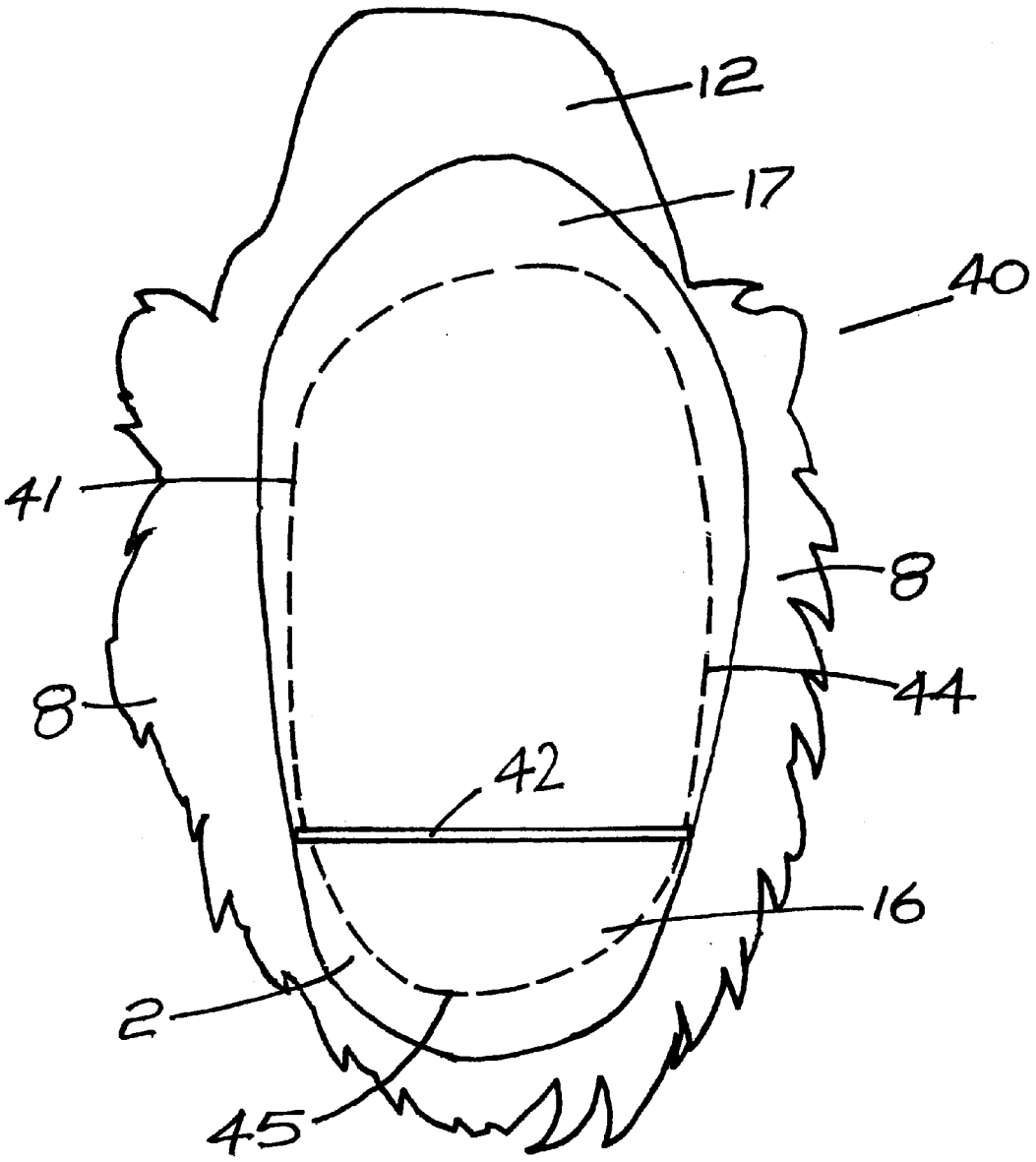
FIG. 6 is a view similar to FIG. 3 of another slipper according to a fourth embodiment of the invention.

Referring now to FIG. 6, there is shown another slipper according to a fourth embodiment of the invention, indicated generally by the reference numeral 40. Parts similar to those described previously are assigned the same reference numerals. In this case, a pocket 41 (indicated in broken outline) is formed in the sole 2 having a hand inlet opening 42 intermediate the heel end 16 and the toe end 17 of the sole 2. The hand inlet opening 42 divides the pocket 41 into a front portion 44 extending towards the toe end 17 for reception of the four fingers of a hand and a rear portion 45 extending towards the heel end 16 for reception of a thumb of a hand. This arrangement facilitates opposition of the thumb and fingers to aid in manipulation of the puppet.

Figure 7:
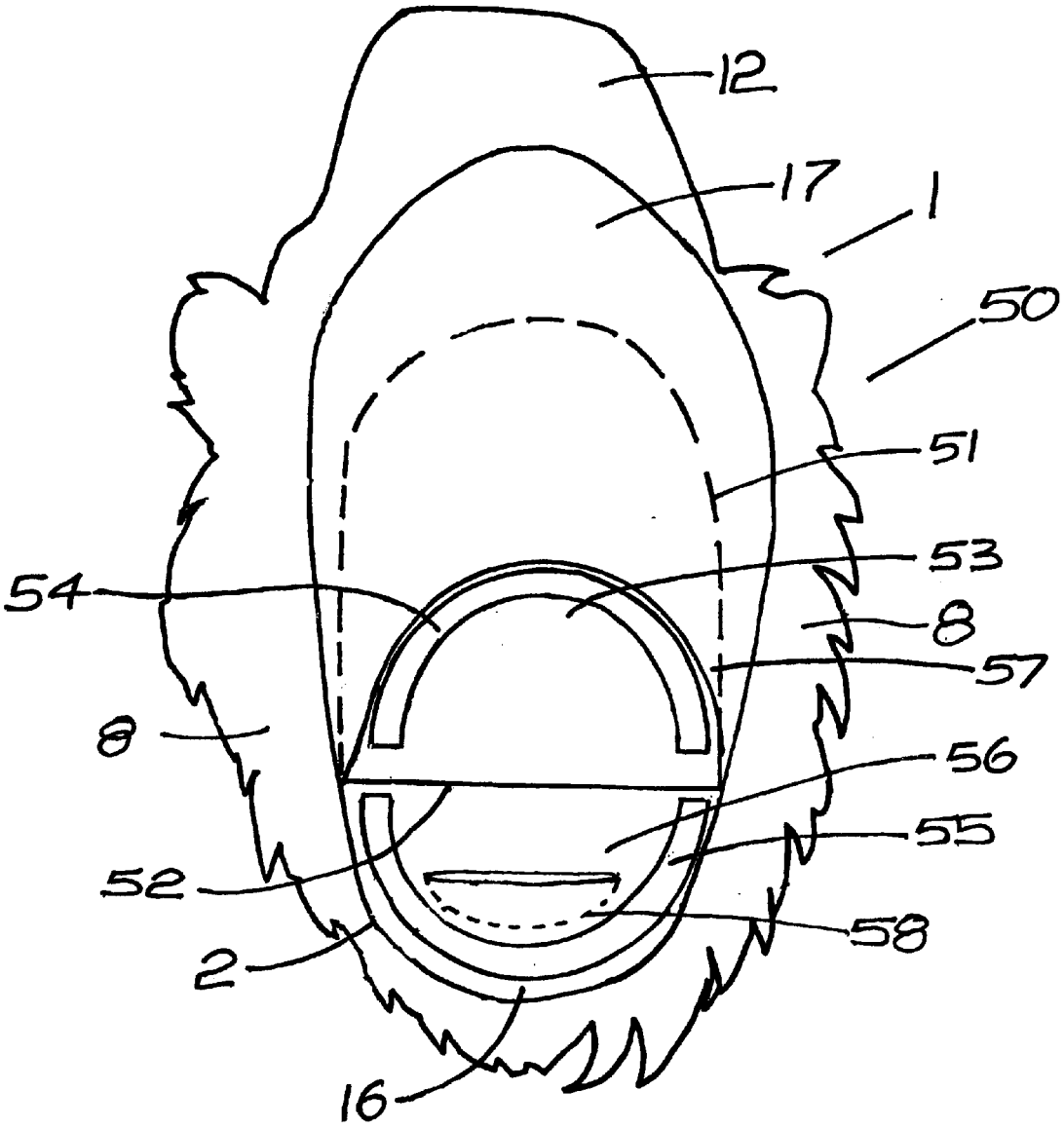
FIG. 7 is a view similar to FIG. 3 of another slipper according to a fifth embodiment of the invention.

Referring now to FIG. 7, there is shown another slipper according to a fifth embodiment of the invention indicated generally by the reference numeral 50. Parts similar to those described previously are assigned the same reference numerals. In this case, a pocket 51 is formed in the sole 2 having an inlet opening 52 which is accessed by raising a flap 53 which is normally secured overlying the heel end 16 by complementary interengagable hook and pile fastener strips 54, 55 on the flap 53 and at the heel end 16. Thus, a smooth bottom face to the sole 2 is achieved when the flap 53 is in a closed position flat against the heel end 16, the flap 53 being integrally formed with a bottom face of the sole 2. Then, when it is desired to use the slipper 50 as a puppet, the flap 53 can be peeled back as shown in the drawing for a user to insert his hand into the pocket 51 for manipulation of the puppet. The sole 2 can essentially be formed in two layers, an inner layer 56 and an outer layer 57 with the flap 53 being formed in the outer layer 57 at a rear or heel end of the outer layer 57. Front portions of the layers 56, 57 are permanently secured together about their periphery defining the pocket 51 and the heel ends of the layers 56, 57 are releasably secured together by means of the flap 53 and associated hook and pile fastener strips 54, 55. A thumb pouch 58 may be provided at the heel end 16 on the inner layer 56 for improved grip and opposition of the thumb and fingers of a hand in manipulating the puppet.

It is also envisaged that means may be provided for playing a pre-recorded message, a musical tune or slogan, either operatively connected into manipulation of the slipper as a puppet or operated independently. Any suitable arrangement for this may be used to provide a "Happy Birthday" or other audible greeting message as desired.

It will be appreciated that the slippers may be decorated to form any suitable head, either real or imaginary, of animals or persons to provide an attractive pair of slippers. Further, each one of the pair of slippers may have the same decoration or may be decorated differently to provide different heads and hence a pair of different puppets.

It will be appreciated that the materials of construction of the slipper should be such as to allow manipulation of at least the puppet portion for animation of the puppet. Conveniently, a foam based sole may be provided to provide good cushioning support for use as a slipper and to allow manipulation in the manner of a puppet when desired. To form a hand receiving pocket in the sole, a pair of foam pads may be provided allowing a hand to be slipped between said pads for manipulating the puppet.

It is envisaged that while the provision of a flexible sole is particularly convenient for facilitating easy manipulation of the puppet, in some cases a rigid or substantially rigid sole may be provided. In this case, however, it would be essential that the puppet portion of the slipper be sufficiently flexible to allow animation of the puppet by manual manipulation.

The term "slipper" as used throughout this specification should be taken to include footwear generally. In respect of such footwear in combination with a puppet, at least the puppet character portion of the footwear should be capable of being manipulated in the manner of a hand puppet for animation of the puppet character.

In the specification the terms "comprise, comprises, comprised and comprising" or any variation thereof and the terms "include, includes, included and including" or any variation thereof are considered to be totally interchangeable and they should all be afforded the widest possible interpretation.

The invention is not limited to the embodiments hereinbefore described which may be varied in both construction and detail within the scope of the appended claims.

What is claimed is:

1. A slipper that is also a hand puppet wherein the slipper comprises:

a sole having an upper attached to the sole and forming therewith a pocket for reception of a person's foot, decoration representing a puppet character being provided on the slipper, hand gripping means on the slipper associated with the puppet character for gripping the slipper and manipulating the puppet character by hand to animate the puppet character, the hand gripping means comprising a pocket for reception of a person's hand, the pocket being provided on the sole, and the pocket having a hand inlet opening intermediate a toe end and a heel end of the sole defining a pocket which extends in opposite directions from the hand inlet opening towards the toe end and towards the heel end.

2. A slipper as claimed in claim 1, wherein the puppet character is provided on the upper.

3. A slipper as claimed in claim 1, wherein the puppet character represents the head of a person or animal.

4. A slipper as claimed in claim 3, wherein an inlet of the foot receiving pocket defined by the sole and upper forms a mouth of the head.

5. A pair of slippers of the type claimed in claim 1.

6. A pair of slippers as claimed in claim 5, wherein both slippers include the same puppet character.

7. A pair of slippers as claimed in claim 5, wherein each of the slippers includes a different puppet character.

8. A slipper that is also a hand puppet wherein the slipper comprises:

a sole having an upper attached to the sole and forming therewith a pocket for reception of a person's foot, decoration representing a puppet character being provided on the slipper, hand gripping means on the slipper associated with the puppet character for gripping the slipper and manipulating the puppet character by hand to animate the puppet character, the hand gripping means comprising a pocket for reception of a person's hand, the pocket being provided on the sole, and an inlet of the pocket being closed by a flap which is integrally formed with an outer layer of the sole, said flap being movable between a closed position sealing the opening and an open position allowing access to the opening, with retaining means for releasably securing the flap in a closed position.

9. A slipper that is also a hand puppet wherein the slipper comprises:

a sole having an upper attached to the sole and forming therewith a pocket for reception of a person's foot, decoration representing a puppet character being provided on the slipper, hand gripping means on the slipper associated with the puppet character for gripping the slipper and manipulating the puppet character by hand to animate the puppet character, the hand gripping means comprising a set of finger receiving slots, and the finger receiving slots being provided on the sole.

* * * * *